US008760081B2

(12) United States Patent
Hagen et al.

(10) Patent No.: US 8,760,081 B2
(45) Date of Patent: Jun. 24, 2014

(54) SYSTEMS AND METHODS FOR BACKLIGHT DRIVING

(75) Inventors: Mark D. Hagen, Rochester, MN (US); Eric G. Oettinger, Rochester, MN (US)

(73) Assignee: Texas Instruments Incorporated, Dallas, TX (US)

( * ) Notice: Subject to any disclaimer, the term of this patent is extended or adjusted under 35 U.S.C. 154(b) by 889 days.

(21) Appl. No.: 11/552,697

(22) Filed: Oct. 25, 2006

(65) Prior Publication Data

US 2007/0103093 A1 May 10, 2007

Related U.S. Application Data

(63) Continuation-in-part of application No. 11/461,808, filed on Aug. 2, 2006, now abandoned.

(60) Provisional application No. 60/704,612, filed on Aug. 2, 2005.

(51) Int. Cl.
*H05B 37/02* (2006.01)

(52) U.S. Cl.
USPC ..... 315/307; 315/308

(58) Field of Classification Search
USPC ..... 315/209 R, 291, 307, 169.1–169.3, 308
See application file for complete search history.

(56) References Cited

U.S. PATENT DOCUMENTS 6,812,916 B2 * 11/2004 Hwang ..... 345/102
2006/0049959 A1 * 3/2006 Sanchez ..... 340/855.3

OTHER PUBLICATIONS

Consentino, G."A CCFL Application Considering the Full Bridge Solution Using STS3C3FOL", Application Note, Mar. 2004, pp. 1-55,AN1899, STMicroelectronics Group, USA.
Harkavy, Brad, "An Introduction to High Bright LCD's", Vert, New England Chapter Society for Information Display, pp. 1-50.
Kahl, John H., Cold Cathode Fluorescent Lamps (CCFL's), JKL Components Corp.,Application Information, RevD, Sep. 1997, pp. 1-7, A1-001, JKL Components.
Kahl, John H., Cold Cathode Fluorescent Lamps (CCFL's), JKL Components Corp., Application Information, RevC, Oct. 1997,pp. 1-3, A1-002, JKL Components.
Kahl, John H.,"Innovative Solutions to High Volume Lamp Applications", Teh Brief, Aug. 12, 2004, pp. 1-2, TB-1015, JKL Components.
Kahl, John H., Understanding Cold Cathode Fluorescent Lamps (CCFL's), Application Information, Rev.A., Nov. 1998, pp. 1-5, A1-007, JKL Components.

(Continued)

*Primary Examiner* — Jimmy Vu
(74) *Attorney, Agent, or Firm* — Alan A. R. Cooper; W. James Brady, III; Frederick J. Telecky, Jr.

(57) ABSTRACT

Various systems and methods for LCD backlight control are disclosed herein. For example, some embodiments of the present invention provide an LCD backlight circuit with an analog inverter circuit that provides a drive voltage to a lamp. A current traversing the lamp is sensed and provided to a digital control circuit. Based on the sensed current, the digital control circuit generates a control signal that is fed back to the analog inverter circuit. In some cases, the digital control circuit is used to cause a gradual increase in voltage applied to the lamp to achieve ignition of the lamp. In other cases, the digital control is used to provide a pre-distorted sine wave that attenuates one or more harmonics introduced into the system by the non-linearities of the lamp.

13 Claims, 6 Drawing Sheets

(56) References Cited

OTHER PUBLICATIONS

Lin, Chang-Hua, "The Design and Implementation of a New Digital Dimming Controller for the Backlight Resonant Inverter", IEEE Trans. on Power & Electronics, Nov. 2005, pp. 1459.
STMicroelectronics,"Design and Realization of a CCFL Application Using TSM108, STN790A, or STS3DPFS30, and STSA1805", Application Note, Jun. 2004, pp. 1-56, AN1722, STMicroelect.
Texas Instruments,"Multi-Topology Piezoelectric Transformer Controller", Texas Instruments, Nov. 2001, Rev.Jan. 2002, pp. 1-27, SLUS499A, Texas Instruments Inc., Dallas.
Texas Instruments,"BICMOS Cold Cathode Fluorescent Lamp Driver Controller", Unitrode Products from Texas Instruments, Oct. 1998, rev.Nov. 2000, pp. 1-17, SLUS252B, TI, Inc, Dallas.
Texas Instruments,"UCC3973 Evaluation Board Design Note", Unitrode Products from Texas Instruments, DN-111, Mar. 2000, pp. 1-5, SLUA238A, TI, Inc,. Dallas.
Texas Instruments,"Understanding Piezoelectric Transformers in CCFI Backlight Application", Analog Applications Journal, Oct. 2002, pp. 18-23, TI, Inc., Dallas.
Travis, Bill, "Little IC's Generate Big Voltages", EDN, Jun. 22, 2000, pp. 73-82.
Warren, Dewight, "Design Challenges in Backlighting LCD TV's", Power Electronics Technology, May 2005, pp. 40-46, Power Electronics Technology.
Wells, Eddy,"Comparing Magnetic and Piezoelectric Transformer Approaches in CCFL Applications", Anaolog Applications Journal, Oct. 2002, pp. 12-17, TI, Inc., Dallas.
Williams, Jim,"A Fourth Generation of LCD Backlight Technology", Linear Technology Application Note 65, Nov. 1995, pp. 1-124, LT/GP 1195, Linear Technology Corp., Millpitas, CA.
Williams, Jim et al.,"Ultracompact LCD Backlight Inverters", Linear Technology Application Note 81, Sep. 1999, pp. 1-24, an81flT/TP 0999 4K, Linear Technology Corp, Milpitas, CA.

* cited by examiner

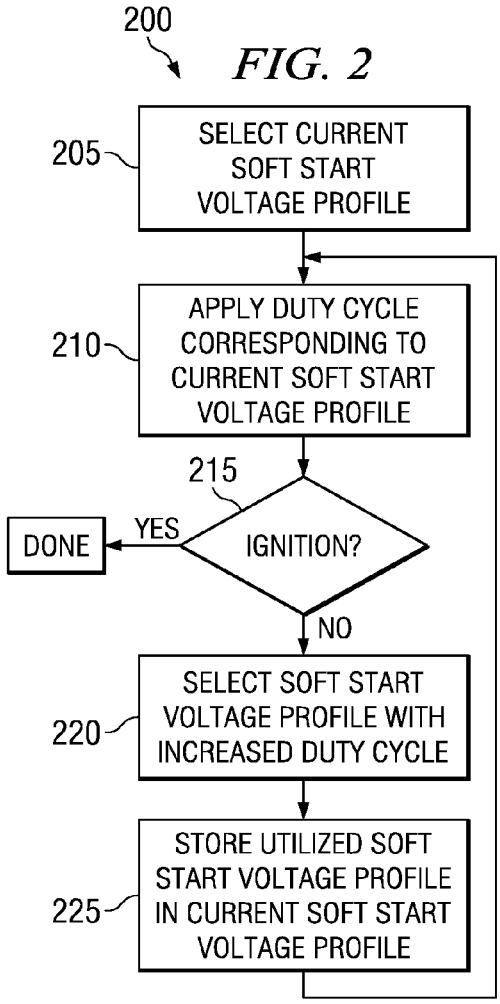
200
FIG. 2
205
SELECT CURRENT SOFT START VOLTAGE PROFILE
210
APPLY DUTY CYCLE CORRESPONDING TO CURRENT SOFT START VOLTAGE PROFILE
215
IGNITION?
YES
DONE
NO
220
SELECT SOFT START VOLTAGE PROFILE WITH INCREASED DUTY CYCLE
225
STORE UTILIZED SOFT START VOLTAGE PROFILE IN CURRENT SOFT START VOLTAGE PROFILE

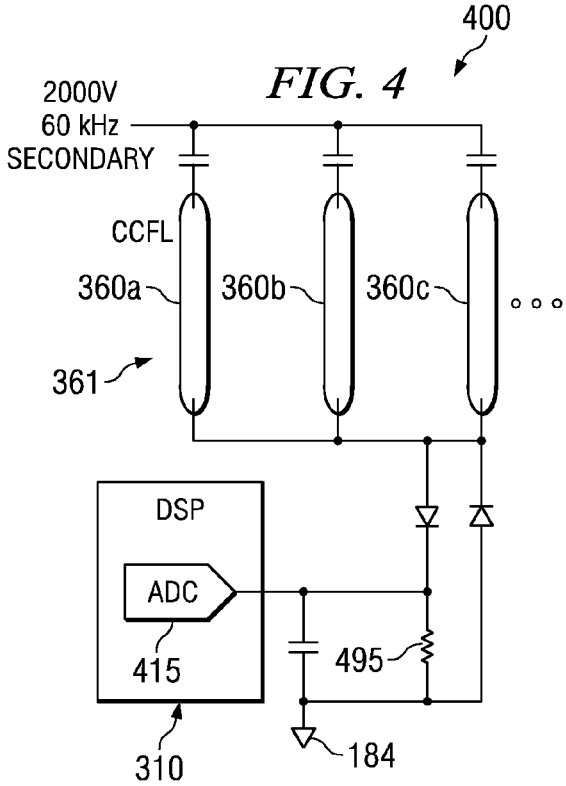
400
FIG. 4
2000V
60 kHz
SECONDARY
CCFL
360a
360b
360c
361
DSP
ADC
415
495
310
184

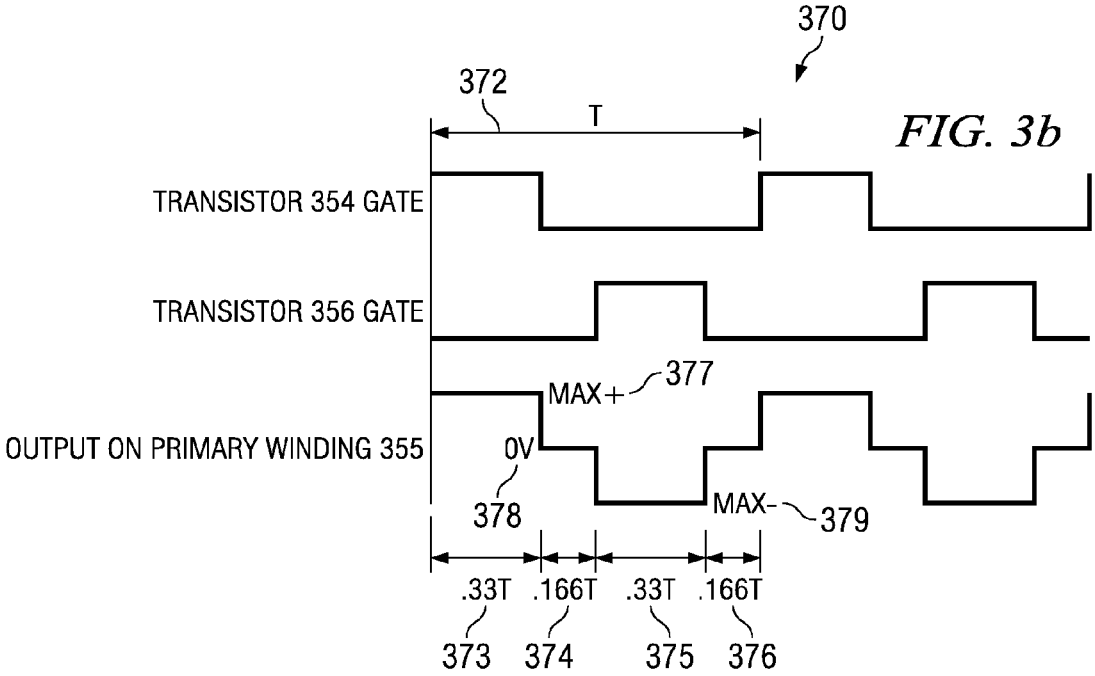
370
372
T
FIG. 3b
TRANSISTOR 354 GATE
TRANSISTOR 356 GATE
MAX+
377
OUTPUT ON PRIMARY WINDING 355
0V
378
MAX-
379
.33T
.166T
.33T
.166T
373
374
375
376

SYSTEMS AND METHODS FOR BACKLIGHT DRIVING

CROSS REFERENCE TO RELATED APPLICATIONS

The present application is a continuation-in-part of U.S. patent application Ser. No. 11/461,808, entitled "LCD BACKLIGHT DRIVER" and filed Aug. 2, 2006 by Hagen et al., which in turn claims priority to U.S. Provisional Patent Application Ser. No. 60/704,612, entitled "LCD BACKLIGHT DRIVER" and filed Aug. 2, 2005. Both of the aforementioned applications are assigned to an entity common hereto and incorporated herein by reference for all purposes.

BACKGROUND OF THE INVENTION

The present invention is related to liquid crystal displays and, more particularly, to improved drivers for controlling the backlight of liquid crystal displays.

The overall cost of various electrical products is substantially driven by the cost of an included liquid crystal display, and the reliability of such products is often a function of the reliability of the liquid crystal display. Hence, improving the reliability of liquid crystal displays may impact the reliability of a variety of products. A liquid crystal display utilizes a backlight consisting of several fluorescent lamps to display information provided to the display, and the reliability of a liquid crystal display is significantly influenced by the lifetime of the aforementioned fluorescent lamps. While all the factors that influence the lifetime of fluorescent lamps are not completely understood, one of the factors effecting lamp longevity is the waveform of the voltage driving the lamps. The lamps are typically driven with a sinusoidal waveform; however, sudden starts are known to be a lifetime influencing event. With the uncertainty of factors affecting life, more control of the waveform is desirable.

Thus, for at least the aforementioned reasons, there exists a need in the art for advanced systems and methods for controlling the backlight of liquid crystal displays.

BRIEF SUMMARY OF THE INVENTION

The present invention is related to liquid crystal displays and, more particularly, to improved drivers for controlling the backlight of liquid crystal displays.

Some embodiments of the present invention provide an LCD backlight circuit with an analog inverter circuit that provides a drive voltage to a lamp. A current traversing the lamp is sensed and provided to a digital control circuit. Based on the sensed current, the digital control circuit generates a control signal that is fed back to the analog inverter circuit. In some cases, the digital control circuit is used to cause a gradual increase in voltage applied to the lamp to achieve ignition of the lamp. In other cases, the digital control is used to provide a pre-distorted sine wave that attenuates one or more harmonics introduced into the system by the non-linearities of the lamp.

Other embodiments of the present invention provide LCD backlight control circuits. Such circuits include a class-D inverter that provides a drive voltage, and a digital signal processor that provides a pulse width modulated output to the class-D inverter. The digital signal processor is programmed to drive the pulse width modulated output with a varying duty cycle designed to induce a pre-distorted sinusoidal voltage on the drive voltage. The pre-distorted sinusoidal voltage is designed to result in a substantially pure sinusoidal current traversing the load by attenuating a harmonic introduced by a non-linearity in the load. In some instances of the aforementioned embodiments, the digital signal processor further includes a plurality of soft start voltage profiles that are each designed to cause a different magnitude profile on the drive voltage. In such instances, the digital signal processor may be further programmed to provide the pulse width modulated signal with a first duty cycle that results in a first magnitude of the drive voltage, to compare the sensed current to a current threshold, and based on the comparison, to provide the pulse width modulated signal with a second duty cycle. The second duty cycle results in a second magnitude of the drive voltage, the second duty cycle is greater than the first duty cycle, and the second magnitude is greater than the first magnitude.

Yet other embodiments of the present invention provide methods for controlling an LCD backlight. Such methods include sensing a current driven across a load by analog inverter circuit that may be, for example, a Royer oscillator inverter, a push-pull inverter, or a class-D inverter. Based at least in part on the sensed current, a pulse width modulated control signal is generated, and the pulse width modulated control signal is applied to the analog inverter circuit. Application of the pulse width modulated control signal to the analog inverter circuit causes a modification in a drive voltage of the analog inverter circuit.

In some instances of the aforementioned embodiments, the load is a lamp that is electrically coupled to the analog inverter circuit by a wire. The electrical coupling may be by a wire, a capacitor, some other component, and/or combinations of the aforementioned. The sensed current is a current traversing a lamp, and the control signal is a pulse width modulated signal. In such instances, the methods may further comprise providing a plurality of soft start voltage profiles that are each designed to cause a different magnitude profile on the drive voltage; and selecting one of the plurality of soft start voltage profiles. The duty cycle of the pulse width modulated signal is at least in part controlled by the selected soft start voltage profiles. In some instances of the aforementioned embodiments, the methods further include providing the pulse width modulated signal with a first duty cycle that results in a first magnitude of the drive voltage, and comparing the sensed current to a current threshold. Based on the comparison, the pulse width modulated signal with a second duty cycle is provided. The second duty cycle results in a second magnitude of the drive voltage and is greater than the first duty cycle. The second magnitude is greater than the first magnitude.

In other instances of the aforementioned embodiments, the analog inverter is a class-D inverter, and the control signal is designed to induce a pre-distorted sinusoidal voltage on the drive voltage. In such instances, the methods may further include forming the pre-distorted sine wave. Forming the pre-distorted sine wave includes identifying a harmonic introduced by a lamp driven by the class-D inverter; and applying a distortion to a substantially pure sine wave designed to attenuate the identified harmonic. In some particular cases, the harmonic includes a third harmonic introduced by a non-linearity of the lamp.

Yet further embodiments ofthe present invention provide an LCD backlight circuit with a lamp, an analog inverter circuit, and a digital control circuit. The analog inverter circuit provides a drive voltage to the lamp, and the digital control circuit receives a derivative of the drive voltage. The digital control circuit generates a control signal based at least in part on the derivative of the drive voltage. The control signal is fed back to the analog inverter circuit.

This summary provides only a general outline of some embodiments according to the present invention. Many other objects, features, advantages and other embodiments of the present invention will become more fully apparent from the following detailed description, the appended claims and the accompanying drawings.

BRIEF DESCRIPTION OF THE DRAWINGS

A further understanding of the various embodiments of the present invention may be realized by reference to the figures which are described in remaining portions of the specification. In the figures, like reference numerals are used throughout several drawings to refer to similar components. In some instances, a sub-label consisting of a lower case letter is associated with a reference numeral to denote one of multiple similar components. When reference is made to a reference numeral without specification to an existing sub-label, it is intended to refer to all such multiple similar components.

FIG. 2 is a flow diagram depicting a method in accordance with various embodiments of the present invention for ramping a strike voltage;

FIG. 3*b* is a timing diagram that shows exemplary signals applied to the gates of the transistors of the push-pull inverter of FIG. 3*a* and a corresponding pulse width modulated output;

FIG. 4 shows an alternative to the backlight voltage controller of FIG. 3 where the current traversing the entire lamp bank is sensed by a common sense resistor and analog to digital converter in accordance with various embodiments of the present invention.

DETAILED DESCRIPTION OF THE INVENTION

Figure 1:
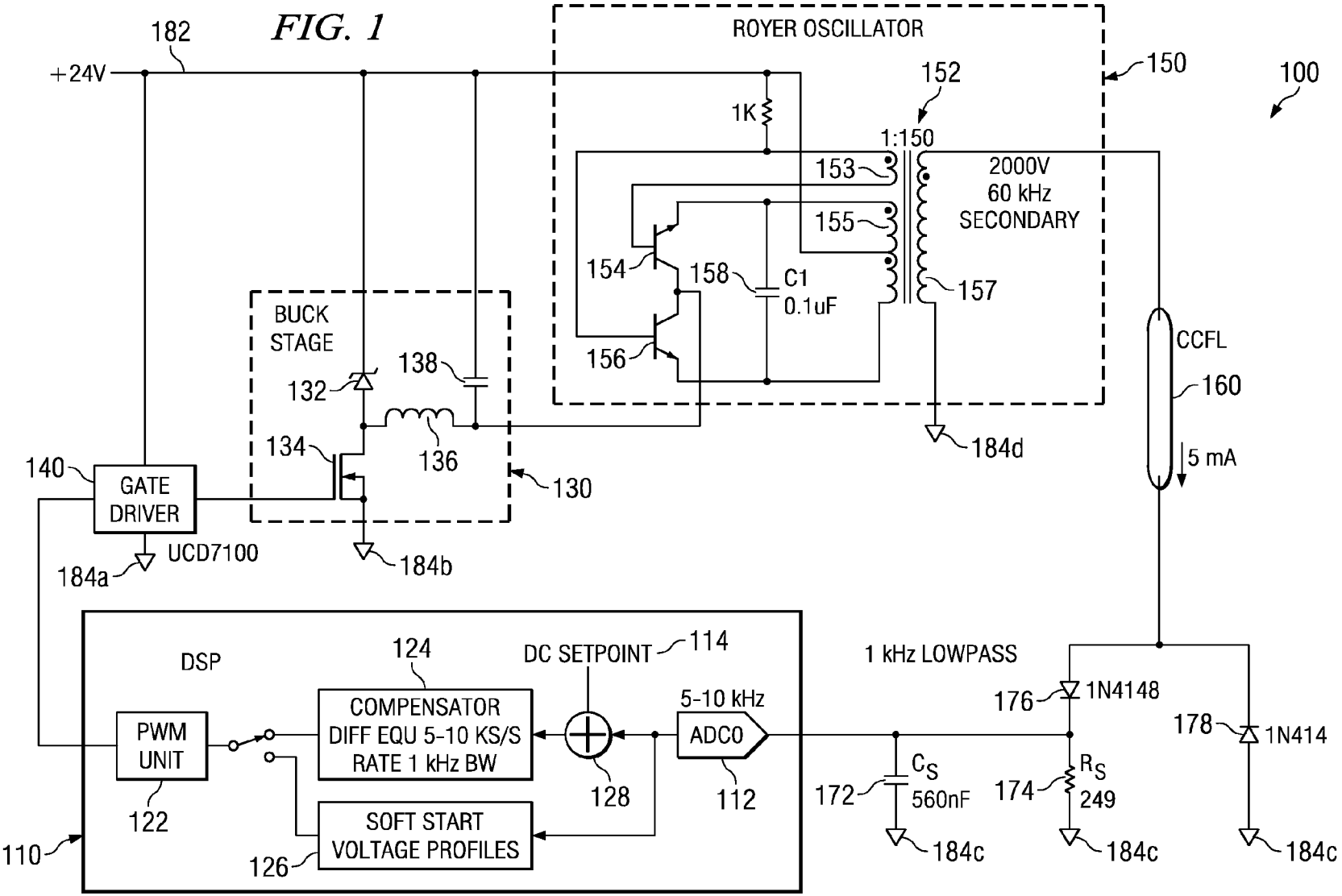
FIG. 1 shows a backlight voltage controller including a Royer oscillator inverter and a digital signal processor control element in accordance with one or more embodiments of the present invention.

The present invention is related to liquid crystal displays and, more particularly, to improved drivers for controlling the backlight of liquid crystal displays.

Cold Cathode Fluorescent (CCF) lamps and External Electrode Fluorescent (EEF) lamps are similar to the neon gas-discharge lamp invented in 1910 by Georges Claude in Paris, France. Like all fluorescent lamps, CCF and EEF lamps work by applying a voltage across the lamp that is sufficiently large to ionize the contained gas which stimulates the phosphor coating inside the glass lamp envelope. CCF lamps are so named because of the type of electrode in the lamp ends. The typical CCF lamp is a hollow glass cylinder coated inside with a phosphor material composed of rare earth elements and sealed with a gettered electrode at both ends. The lamps normally contain 2-10 milligrams of mercury along with a mixture of gases, such as argon and neon. Ultraviolet energy at 253.7 nm is produced by ionization of the mercury and penning gas mixture by the application of high voltage through the tube. A further discussion of CCF lamps is provided in KAHL, John H., "CCFL's, A History And Overview," JKL Components Corporation, App. Note # AI-002, 1997. The aforementioned reference is incorporated herein by reference for all purposes. EEF lamps operate similar to CCF lamps, except that the electrode is external to the glass tube and the excitation voltage is capacitively applied to the gas. In the discussion that follows, lamps are referred to as CCF lamps, EEF lamps, fluorescent lamps and simply lamps or tubes Tt should be noted that the backlight controllers and control processes discussed herein may be applied to any type of fluorescent lamps, and that the discussion of a particular type of lamp in the detailed description is not intended to limit the scope of the present application.

To drive a CCF lamp, a large sinusoidal voltage is initially applied to the electrodes to initiate the ionization of the gas. This initial voltage application is referred to as the "strike voltage" and for a typical 3.0 mm by 380 mm lamp the strike voltage may be as high as 2000V. Once the lamp begins to conduct, the impedance of the lamp drops and the applied voltage is reduced in order to arrive at the desired lamp current (e.g., approximately 5 mA). This negative impedance as the lamp is being ignited is one of the confounding aspects of CCF lamp drive circuits. This aspect of CCF lamps is more fully described in WILLIAMS, Jim, "A Fourth Generation of LCD Backlight Technology", Linear Technology Application Note #65, November 1995. The aforementioned reference is incorporated herein by reference for all purposes. The light output of a CCF lamp degrades over the operational life of the lamp due at least in part to degradation of the lamp phosphor. CCF lamp life ratings can be obtained from lamp manufactures' catalogs and may be, for example, 20,000 hours to 50% of the lamps initial output at a drive current of 5 mA RMS. Of note, both fast voltage rise times and DC content in the drive voltage have been shown to degrade the phosphor by encouraging mercury vapor migration. Some embodiments of the present invention provide a low crest factor sinusoidal waveform with minimal DC to alleviate the aforementioned life reducing circumstances, and therefore extend lamp life.

The driving frequency of a CCF lamp or EEF lamp is selected as a trade off between component cost (e.g., higher frequencies allow smaller components) and efficiency (e.g., higher frequencies mean more switching loss and more capacitive losses in the wiring between the high voltage transformer and the lamp). Typically a frequency between forty and sixty kHz is chosen to drive the lamps. To minimize fast edges on the drive current, a sinusoidal voltage is generated to drive the lamp. Use of a sinusoidal drive voltage, however, may not be enough to limit the slew rate of the lamp current as the nonlinear V-I characteristics of lamp may introduce substantial harmonics in the lamp current. To more minutely address the nonlinear V-I characteristics (later referred to herein as "non-linearities"), some embodiments of the present invention pre-distort the sinusoidal drive waveform to further reduce the slew rate of the lamp current. In particular embodiments of the present invention, soft start techniques are utilized to manage the current transient as the lamp initially starts and thereby maximize lamp life. Such soft start techniques minimize the potential of current spikes at initiation of the lamp. In various embodiments of the present invention, one algorithm may be applied in a cold start scenario and a different algorithm may be applied in a pulse width modulated dimming interval. Further, over the lifetime of a lamp ever increasing strike voltages may be required to ignite the lamp. To compensate for this tendency, the aforementioned soft start techniques may provide for a gradual increase in strike voltage over the lifetime of a lamp. In this way, a maximum predicted strike voltage (i.e., the strike voltage that is predicted toward the end of a lamp's life) need not necessarily be applied at all start up instances, but rather a strike voltage tailored for the particular startup scenario may be utilized.

Some embodiments of the present invention provide an LCD backlight circuit with an analog inverter circuit that is electrically coupled to and provides a drive voltage to a lamp. A current traversing the lamp is sensed and provided to a digital control circuit. Based on the sensed current, the digital control circuit generates a control signal that is fed back to the analog inverter circuit. In some cases, the digital control circuit is used to cause a gradual increase in voltage applied to the lamp to achieve ignition of the lamp. In other cases, the digital control is used to provide a pre-distorted sine wave that attenuates one or more harmonics introduced into the system by the non-linearities of the lamp. As used herein, the phrase "electrically coupled" is used in its broadest sense to mean any coupling whereby an electrical signal may be passed from one component to another. Thus, for example, a wire may electrically couple two components, a transistor may electrically couple two or more components, a device such as a multiplexer or a gate driver may electrically couple two or more components. Based on the disclosure provided herein, one of ordinary skill in the art will recognize a variety of electrical couplings that may be used in accordance with various embodiments of the present invention. Also, as used herein the phrase "pre-distorted" sine wave is used in its broadest sense to mean any substantially pure sine wave that is purposely modified. Thus, for example, a pre-distorted sine wave may be a sine wave with an added harmonic that is designed to account for a non-linearity of a load. Further, as used herein, the phrase "derivative of the drive voltage" is used in its broadest sense to mean any detectable signal that is derived from the drive voltage. Thus, for example, a derivative of the drive voltage may be a current induced through a load by application of the drive voltage to the load. Such a current may be measured as a voltage drop across a sense resistor. As another example, a derivative of the drive voltage may be a voltage level at a circuit node that is impacted by application of the drive voltage.

Turning to FIG. 1, a backlight voltage controller 100 including a Royer oscillator inverter 150 and a digital signal processor control element 110 in accordance with one or more embodiments of the present invention is depicted. As shown, backlight voltage controller 100 utilizes a power source 182 and a ground 184. Royer oscillator inverter 150 includes a transformer 152 with three windings 153, 155, 157. Winding 157 of transformer 152 is electrically coupled to a CCF lamp 160. In this application, a linear oscillator is formed where a transistor 154 and a transistor 156 are alternatively driven by a winding 153 of transformer 152, and the sources of transistors 154, 156 are electrically coupled to opposing ends of winding 155 of transformer 152. The voltage across Royer oscillator inverter 150 is provided by a switch-mode converter stage 130. In some cases, switch-mode converter stage 130 is a buck stage including a transistor 134, a diode 132, an inductor 136 and a capacitor 138. As shown, the buck stage is flipped relative to power source 182 so that transistor 134 can be driven from ground.

The drive frequency of backlight voltage controller 100 is defined by the LC tank consisting of the transformer primary and a capacitor 158. This oscillation frequency will vary with component drift, tolerance variation, and load current. In some particular embodiments of the present invention, the drive frequency will be 55 kHz±5 kHz. An optional capacitor (not shown) connected between Royer oscillator inverter 150 and CCF lamp 160 may be used to provide a ballast impedance for lamp 160 that limits the current through lamp 160 during normal operation. However, it should be noted that applications utilizing digital signal processor control element provide sufficient control such that the aforementioned ballast capacitor may be eliminated. CCF lamp 160 is electrically coupled to ground via a pair of parallel diodes 176, 178 with reversed polarity; and by a low pass filter comprising a sense resistor 174 in parallel with a capacitor 172. In one particular embodiment of the present invention, the low pass filter is set to operate at one KHz and diodes 176, 178 are implemented using 1N4148 parts. Diodes 176, 178 assure that only a positive voltage occurs across sense resistor 174 even though an AC current is traversing CCF lamp 160.

The voltage applied to Royer oscillator inverter 150 via switch-mode converter stage 130 and a gate driver 140 is controlled via digital signal processor control element 110. In particular, digital signal processor control element 110 receives a current output from CCF lamp 160 measured across sense resistor 174, and converts the current to a digital representation thereof using an analog to digital converter 112. The digital representation of the lamp current is compared with a DC setpoint 114 using a summation and comparison element 128. This comparison results in an error value that is phase compensated using a digital phase compensator 124 and passed directly to pulse width modulation unit 122. In some cases, digital compensator 124 may implement a second order differential equation in digital signal processor control element 110. Digital compensator 124 calculates the duty cycle for each of the pulse width modulated outputs. In some embodiments of the present invention, digital signal processor control element 110 is implemented using a UCD9501 DSP available from Texas Instruments. Of note, a second order compensator is one of several digital power library functions that are available for the UCD9501 DSP.

Further, pulse width modulation unit 122 may be driven by a soft start block 126. In such a case, one of a number of soft start voltage profiles available from soft start block 126 is selected and applied. Such a soft start voltage profile may initially cause pulse width modulation unit 122 to pulse with a duty cycle corresponding to a voltage at or slightly below a previously noted strike voltage. Based on the measured lamp current, digital signal processor control element 110 can determine whether an applied strike voltage resulted in ionization of the gas within CCF lamp 160 (i.e., a current traversing CCF lamp 160 that exceeds a predetermined threshold current). Where ionization has not occurred, another soft start voltage profile may be selected that causes pulse width modulation circuit 122 to pulse at an increased duty cycle corresponding to an increased strike voltage. This process of steadily increasing the strike voltage may be continued until digital signal processor control element 110 detects the desired ionization of CCF lamp 160. By steadily increasing the strike voltage, the voltage used to ignite CCF lamp 160 may be at a minimum initially and then increased only as additional initiation voltage requirements are identified. This avoids the potentially lifetime limiting situation where the voltage required to ignite a lamp late in its life is applied to the lamp over its entire lifetime.

Turning to FIG. 2, a flow diagram 200 depicts a method in accordance with various embodiments of the present invention for ramping a strike voltage. Following flow diagram 200, a soft start voltage profile is selected to produce an ignition level voltage for CCF lamp 160 (block 205). In some cases, the selected soft start voltage profile is the profile that was previously capable of causing ignition. In other cases, the selected soft start voltage profile is a profile one or two levels below the soft start voltage profile that was previously capable of causing ignition. Applying a voltage derived from the aforementioned selected soft start voltage profile results in application of a minimum predicted voltage sufficient to ignite CCF lamp 160, thus potentially extending the lifetime of the lamp. Once the soft start voltage profile is selected (block 205), a duty cycle corresponding to the selected soft start voltage profile is output from pulse width modulation unit 122 (block 210). The output from pulse width modulation unit 122 is applied to Royer oscillator 150 via switch-mode converter stage 130 and causes a voltage corresponding to the selected soft start voltage profile to be applied to CCF lamp 160.

After applying the selected voltage, digital signal processor control element 110 determines whether the applied voltage resulted in ionization (i.e., ignition) of the gas in CCF lamp 160 (block 215). Where ignition did not occur (block 215), a soft start voltage profile with an increased duty cycle is selected (block 220) and stored as the current voltage profile (block 225). Then, a voltage corresponding to the newly identified current soft start voltage profile is applied to CCF lamp 160 (block 210), and it is again determined whether ignition was achieved (block 215). This process of incrementing the duty cycle continues until ignition is achieved, and results in incrementing the voltage level that is initially applied the next time a cold start of CCF lamp 160 is called for. It should be noted that each time an ignition is called for that a common soft start voltage profile may be selected. In such cases, more increment steps (i.e., block 220) may be required later in the life of CCF lamp 160. This is yet another example of incrementing strike voltage that may be used in accordance with various embodiments of the present invention, and based on the disclosure provided herein one of ordinary skill in the art wil recognize yet other approaches that may be used in relation to other embodiments of the present invention.

Figure 3A:
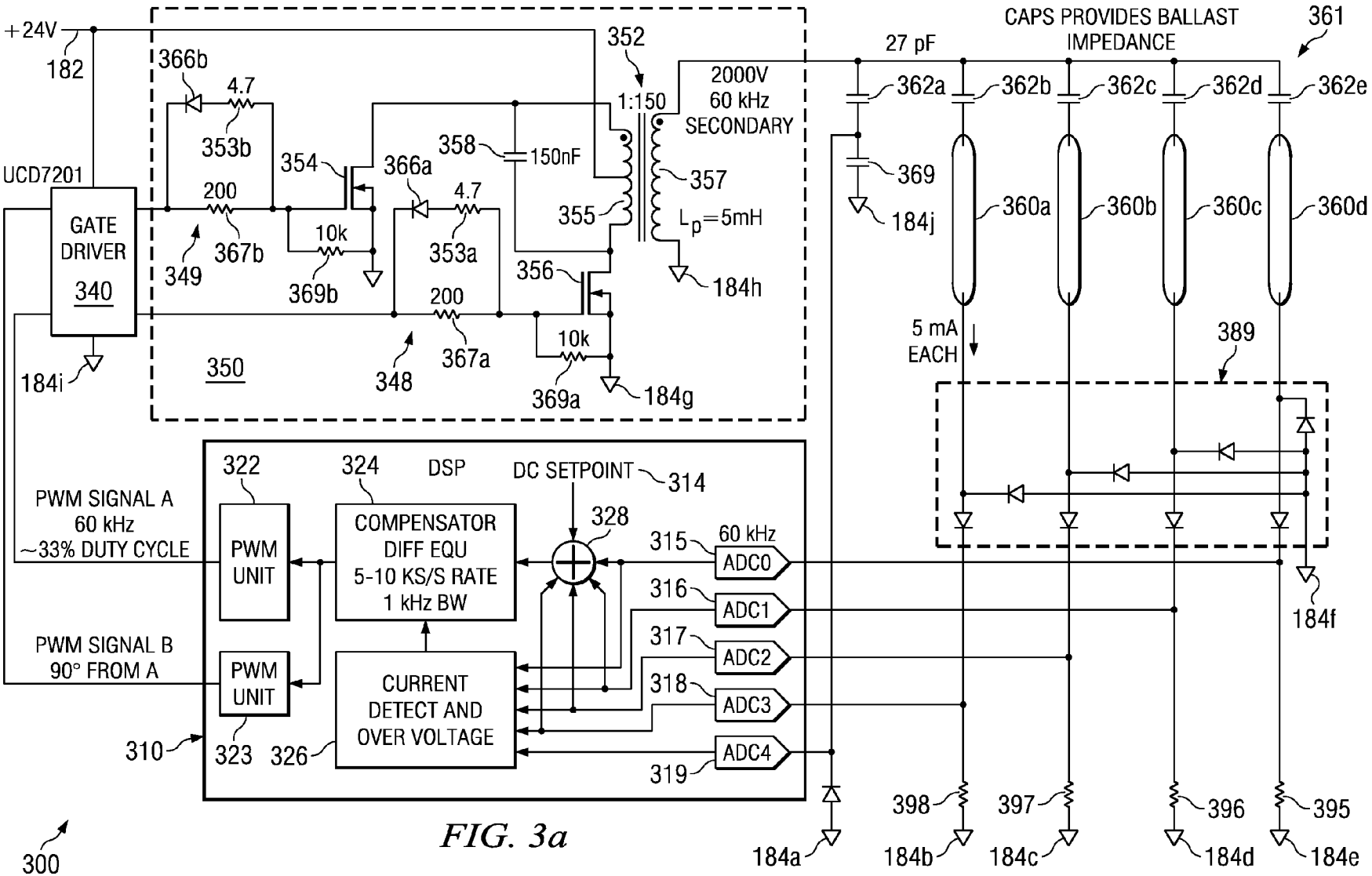
FIG. 3*a* depicts a backlight voltage controller including a push-pull inverter and a digital signal processor control element in accordance with various embodiments of the present invention.

Turning to FIG. 3*a*, a backlight voltage controller 300 including a push-pull inverter 350 and a digital signal processor control element 310 in accordance with various embodiments of the present invention is depicted. In contrast to the linear circuit of FIG. 1 that is tailored for driving one or two CCF lamps, backlight voltage controller 300 may be used to drive applications requiring a larger number of CCF lamps. Push-pull inverter 350 forms a resonant circuit tuned to a desired frequency that is capable of driving a sinusoidal voltage output to a bank 361 of CCF lamps 360. The gates of transistors 354, 356 are each connected to a respective input network 348, 349. Input networks 348, 349 are intended to match the drive of gate driver 340 to the input requirements of transistors 354, 356. As one of ordinary skill in the art will appreciate, a variety of input networks may be designed based on the outputs of gate driver 340 and the input requirements of transistors 354, 356. As shown, input network 349 includes a 10K resistor 369 connected between the drain and gate of transistor 354, a two hundred ohm resistor 367 connected between the gate of transistor 354 and the drive of gate driver 340, and a series of a diode 366 and a 4.7 ohm resistor all in parallel with resistor 367. The same configuration is applied to transistor 356.

In operation, transistor 354 and transistor 356 alternatively drive a center tapped transformer 352 with a primary winding 355 and a secondary winding 357. In particular, transistor 354 is turned on when a pulse width modulated signal from pulse width modulation circuits 322, 323 is asserted high, and turns off when the same signal is asserted low. When transistor 354 is turned on, current ramps in the upper half of primary winding 355, and twice the supply voltage is applied across a capacitor 358 due to the operation of transformer 352. Once the pulse width modulated signal asserts low, transistor 354 turns off and the current circulates between capacitor 358 and primary winding 355 of transformer 352. Transistor 356 operates similarly, but on the opposite cycle of the pulse width modulated input signal. The aforementioned operation results in a sinusoidal voltage output at secondary winding 357 that is applied across lamp bank 361. Each of fluorescent lamps 360 is connected to secondary winding 357 via respective capacitors 362 that provide ballast impedance.

In operation, digital signal processor control element 310 receives a feedback representative of the currents traversing each of CCF lamps 360 and that traversing a capacitive load 369 at respective analog to digital converters 315, 316, 317, 318, 319. The aggregated digital representations of the feedback currents is compared with a DC setpoint 314 using a summation/comparator device 328. This comparison results in an error value that is phase compensated using a digital phase compensator 324 and passed directly to pulse width modulation units 322, 323. In some cases, digital compensator 324 may implement a second order differential equation in digital signal processor control element 310. Digital compensator 324 calculates the duty cycle for each of the pulse width modulated outputs. In some embodiments of the present invention, digital signal processor control element 310 is implemented using a UCD9501 DSP available from Texas Instruments. Of note, a second order compensator is one of several digital power library functions that are available for the UCD9501 DSP.

For push pull inverter 350, the frequency of the pulse width modulated control signal is the same as the frequency of the sinusoidal drive voltage provided to lamp bank 361. Therefore, the inductance of transformer 352 needs to be larger and more expensive that it would need to be if a technique relying on a pulse width modulated frequency that is higher than the drive frequency was used. Such a circuit offering a higher frequency pulse width modulated output is discussed below in relation to FIG. 5 and FIG. 6. On the other hand, a lower frequency circuit such as backlight voltage controller 300 may utilize a relatively low switching frequency which minimizes switching losses.

It should be noted that a group of reversed diodes 389 are used to match an input measuring range of analog to digital converters 315, 316, 317, 318 with the AC current traversing lamps 360 of lamp bank 360. In particular, the analog to digital converters are only capable of measuring positive voltages and the group of diodes assure that only positive voltages are presented to the analog to digital converters. Based on the disclosure provided herein, one of ordinary skill in the art will recognize other matching circuits that may be used to match the input requirements of the analog to digital converters in accordance with one or more embodiments of the present invention. For example, a voltage offset circuit may be used, a voltage divider circuit may be used, or a different set of analog to digital converters may be used. Current detect and over voltage circuit 326 is designed to detect the ignition of each of fluorescent lamps 360 based on a digital current value provided via analog to digital converters 315, 316, 317, 318, 319. In addition, in some cases, current detect and over voltage circuit 326 may be augmented to implement the same soft start algorithms as previously discussed in relation to FIG. 1 above. Such an approach may be used to assure that a sufficient voltage is applied to lamp bank 361 without applying too high of a voltage to lamp bank 361.

Turning to FIG. 3*b*, a timing diagram 370 shows the signals applied to the gates of transistor 354 and transistor 356 and the combined output of transistors 354, 356 (i.e., output on primary winding 355). As shown, a thirty-three percent duty cycle is used to create an optimal sine wave voltage at the input of lamp bank 361. As will be appreciated by one of ordinary skill in the art, the size of the windings of transformer 352 are selected to produce an optimal sine wave from the combined output of FIG. 3*b*. In particular, the gates of transistor 354 is driven for a thirty-three percent interval 373 of an overall period 372. During this time, the output on primary winding 355 is at a maximum positive voltage 377. After interval 373, the gate of transistor 354 is no longer asserted high and at the same time the gate of transistor 356 is not asserted high. This results in a zero voltage 378 for an interval 374 that lasts approximately sixteen percent of overall period 372. At this point, the gate of transistor 356 is asserted high resulting in a maximum negative voltage on primary winding 355 for an interval 375. Interval 375 is approximately thirty-three percent of overall period 372. This is followed by an interval 376 where neither of transistors 354, 356 are turned on for approximately sixteen percent of overall period 372.

In addition, it should be noted that the current traversing each lamp 360 of lamp bank 361 is individually accounted for by a respective analog to digital converter 315, 316, 317, 318 converting a voltage across a respective sense resistor 395, 395, 397, 398. This allows for a very accurate determination of ignition of less than all of lamps 360 in lamp bank 361. In some cases, a digital signal processor may be selected that includes a number of analog to digital conversion channels to implement digital signal processor control element 310. This allows a single digital signal processor to control many CCF lamps 360. In contrast, FIG. 4 shows an alternative portion of backlight voltage controller 300 where the current traversing the entire lamp bank 361 (or some subset of lamp bank 361) is sense by a common sense resistor 495 and analog to digital converter 415. Such an approach may be less accurate than that provided in FIG. 3, but may provide sufficient granularity to determine a failed ignition of one or more lamps in lamp bank 361 at a reduced component cost.

Figure 5:
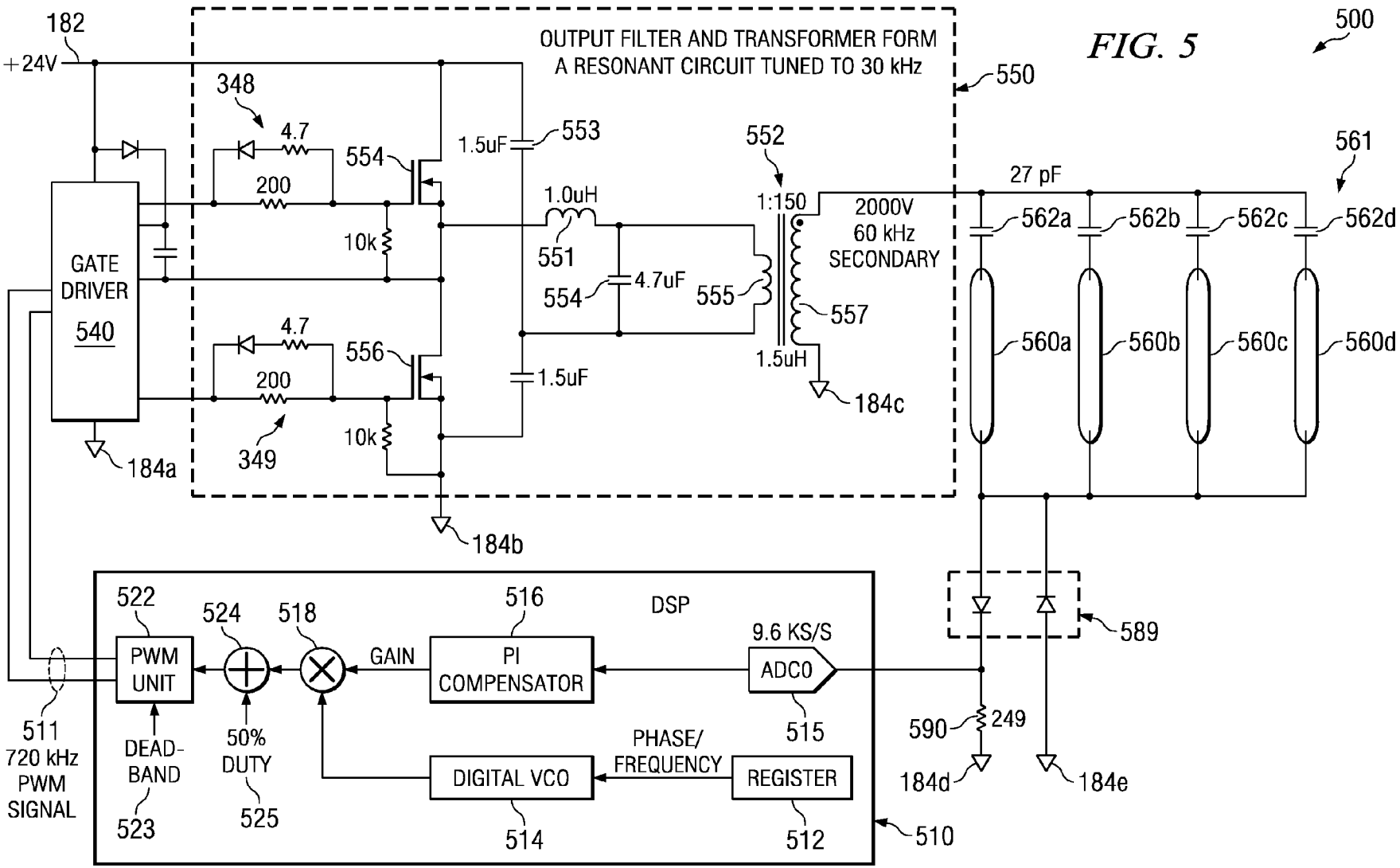
FIG. 5 shows a backlight voltage controller including a class-D inverter and a digital signal processor control element in accordance with some embodiments of the present invention.

Turning to FIG. 5, a backlight voltage controller 500 including a class-D inverter 550 and a digital signal processor control element 510 in accordance with some embodiments of the present invention is depicted. In particular, FIG. 5 shows a half bridge implementation where a transistor 554 and a transistor 556 form a class-D amplifier output section. The aforementioned output section drives a transformer 552 with a primary winding 555 and a secondary winding 557. The secondary winding 557 is electrically coupled to a lamp bank 561. Lamp bank 561 includes a number of parallel connected fluorescent lamps 560. Each of fluorescent lamps 560 is connected to secondary winding 557 via respective capacitors 562. Capacitors 562 provide ballast impedance. The gate of transistor 554 is driven via an input network 348 and the gate of transistor 556 is driven via an input network 349 as previously described in relation to FIG. 3 above. Again, based on the disclosure provided herein, one of ordinary skill in the art will appreciate a number of input networks that may be designed based on the previously described design constraints.

A current output from lamp bank 561 causes a voltage across a sense resistor 590 that only receives positive current due to a pair of diodes 589. The voltage across sense resistor 590 is converted using an analog to digital converter 515. Again, as with the circuit of FIG. 3, each of the lamps 560 in lamp bank 561 (or some subset of lamps 560 of lamp bank 561) may be individually sensed by connecting each to a respective sense resistor and analog to digital controller where such is deemed desirable. Also, diode pair 589 may be replaced with some other circuit designed to match the output of lamp bank 561 with the input requirements of analog to digital converter 515. The voltage value converted by analog to digital controller 515 is then used by other elements of digital signal processor control element 510.

Figure 6:
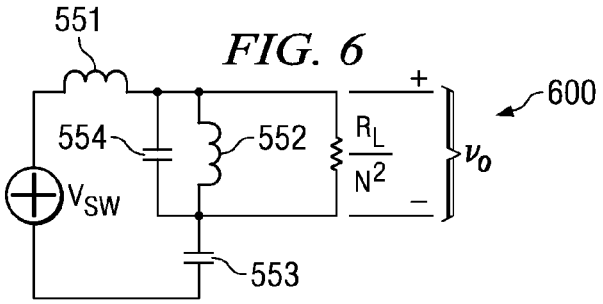
FIG. 6 shows an equivalent circuit for the output filter of class-D inverter of FIG. 5.

FIG. 6 shows an equivalent circuit 600 for the output filter of class-D inverter 550. The frequency domain transfer function for this network is:

$$v_o = \frac{1}{RL_1C_1}\frac{s^2 v_{sw}}{s^4 + \frac{1}{RC_1}s^3 + \left(\frac{1}{L_1C_1} + \frac{1}{L_1C_2} + \frac{1}{L_2C_1}\right)s^2 + \frac{1}{RL_1C_1S_2}s + \frac{1}{L_1L_2C_1C_2}}$$

Where $$R = \frac{R_{Lamp}}{N_{turns}^2}.$$

This forms a fourth order band-pass filter. The inductance of the series inductor 551 (L1) and transformer 552 (L2) are selected based on the desired peak current. Then capacitor 553 (C2), which is actually the parallel combination of two capacitors between the power rail and ground, defines the low frequency corner and capacitor 554 (C1) defines the high frequency, low-pass corner of the filter network. In order to allow the system to compensate for the non-sine lamp current the output filter needs to pass both the fundamental drive frequency and its third harmonic. So, for example, if a drive frequency of forty kHz is chosen, then the band-pass frequencies of the output filter need to run from forty kHz to one hundred, twenty kHz.

Digital signal processor control element 510 includes a proportional integral compensator 516 that is operable to compensate for signal modification in the feedback loop to provide a known steady state operation point as is known in the art. In addition, digital signal processor control element 510 includes a digital VCO 514 that is capable of receiving a frequency input from a register 512 and forming a complex wave form output. The output from digital VCO 514 is multiplied by the gain from proportional integral compensator 516 using a multiplier function 518. The output of multiplier function 518 is provided to an adder function 524 that incorporates an input 525 designed to create a fifty percent duty cycle in circuit 500. Thus, the output of adder function 524 surrounds a fifty percent duty cycle. Thus, for example, the output of adder function 524 may operate between a forty percent duty cycle and a sixty percent duty cycle. A pulse width modulation unit 522 creates pulse width modulated output 511 that drives a class-D inverter 550 via a gate driver 540.

The control technique applied to backlight voltage controller 500 by digital signal processor control element 510 is somewhat different than that described above in relation to the circuits of FIG. 1 and FIG. 3. In particular, for the Royer oscillator and Push-Pull inverter designs the lamp current is sensed and compared to the desired set point to generate an error signal. The error signal is phase compensated and fed directly to a pulse width modulator. For the class-D implementation of FIG. 5, pulse width modulation unit 522 provides a sequence of pulse width modulated periods where the pulse width deviates from a fifty percent duty cycle on a pulse by pulse basis. In this case the pulse width variation follows a sine wave at the drive frequency. The lamp current error signal then is used to vary the transistor on-time (from a fifty percent duty cycle) of the pulse width modulated sequence.

To generate the sine wave sequence, a table lookup sine wave generator can be used. The table consists of N samples covering one cycle of a sine wave. A step state-variable η is defined such that $$\eta = \frac{F_s}{F_{drive}} 2^{16}$$

(for a 16 bit processor). The sine wave is generated by accumulating the variable η to produce phase Θ. Θ is then right shifted 16-log 2($N_{table}$) and used as a pointer into the table to define the sine output. The following pseudo code demonstrates an exemplary approach to creating an arbitrary signal output based on a table lookup approach.

```
#define SINE__TABLE__SCALE 16 – log2(N__TABLE)
#define ETA (2^16)*SAMPLE__RATE/DRIVE__FREQUENCY
theta += ETA;          // allow theta to wrap as it reaches 2^16 //
sine = sineTable[theta >> SINE__TABLE__SCALE];
pwm = gain * sine;     // apply gain based on lamp feedback//
```

The pulse width modulated command for the class-D inverter is driven from a table that is not limited to creating pure sine waves, but rather is capable of creating a pre-distorted sine wave. Indeed, any arbitrary waveform can be encoded into the look-up table and sequenced through at the drive frequency. In this way non-linearities in the lamp V/I curve can be compensated for when constructing the table. The turn on threshold of the lamp generates substantial 3rd harmonic in the lamp current, by adding third harmonic content to the table this distortion can be attenuated.

Digital signal processor control element 510 is designed to calculate and produce pulse width modulated output 511 such that a distorted sinusoidal voltage signal at primary winding 555 of transformer 552 is created. The distorted sinusoidal voltage is designed to account for the non-linearities of fluorescent lamps 560. Said another way, the higher order harmonics caused by lamps 560 are removed from the sinusoidal voltage applied across lamp bank 561. By removing the higher order harmonics from the sinusoidal current through lamps 560, the purity of the sinusoidal voltage received by lamps 560 is increased and in turn the longevity of the lamps is increased. In one particular embodiment of the present invention, the distorted sinusoidal voltage generated by pulse width modulated output 511 is a substantially pure sine wave less the third harmonic that would be introduced by the non-linearities of lamp bank 561. In other embodiments of the present invention, the distorted sinusoidal voltage generated by pulse width modulated output 511 is a substantially pure sine wave less the third and fifth harmonics that would be introduced by the non-linearities of lamp bank 561. In yet other embodiments of the present invention, the distorted sinusoidal voltage generated by pulse width modulated output 511 is a substantially pure sine wave less the third, fifth and seventh harmonics that would be introduced by the non-linearities of lamp bank 561. Based on the disclosure provided herein, one of ordinary skill in the art will recognize that other higher order harmonics may be addressed in accordance with embodiments of the present invention, but that a point of diminishing returns may be reached. This ability to provide a distorted sine wave output is aided by the fact that digital signal processor control element 510 is capable of generating a pulse width modulated output that switches at a frequency much higher that the drive frequency of lamp bank 561. This increase in frequency also allows for use of smaller components at the expense of some additional switching based power dissipation.

One particular embodiment of the present invention utilizes the previously discussed table look up technique to create the desired distorted sine wave output. In particular, digital VCO 514 includes a random access memory with five hundred, twelve discrete values representing the magnitude of an output wave form at given points along the wave form. Thus, for example, where a pure sine wave is to be created, the magnitude across the first quarter of the values (first 128 values) increases in a smooth fashion from zero to the maximum amplitude. The next half of the values decrease in smooth fashion from the maximum amplitude to the minimum amplitude, and the last quarter of the values increase in a smooth fashion from the minimum amplitude to zero. Thus, in the simple case, by serially outputting the magnitude values a sine wave with a step size resolution of five hundred, twelve (or another size depending upon the size of the table utilized) may be created. The step size or granularity may, however, be reduced based on the desired output frequency that is programmed into register 512. In general, the step size is calculated using the following equation:

Step Size=(Table Length*Desired Frequency)/Sample Rate.

It should be noted, however, that by maintaining the fractional part of the step size variable ETA and allowing the table pointer theta to wrap around when it hits its maximum value (e.g., 65,536 for a sixteen bit case), a frequency resolution in excess of the sample rate divided by five hundred, twelve may be achieved when measured over many cycles. In one particular embodiment, the table length is five hundred, twelve; the desired frequency is sixty kHz; and the sample rate is seven hundred, twenty kHz. Thus, the step size is approximately forty three. Thus, in the example instead of outputting each of the stored magnitude values from the read only memory, only one out of each block of forty three stored values in output.

To create a distorted sine wave output, the values stored in the read only memory are modified such that they do not provide for a smooth increase and decrease exhibited in a pure sine wave. Rather, the values are programmed such that the smooth increases and decreases are generally maintained, but the values are adjusted to implement the distortion designed to compensate for the high order harmonic(s).

Figure 7:
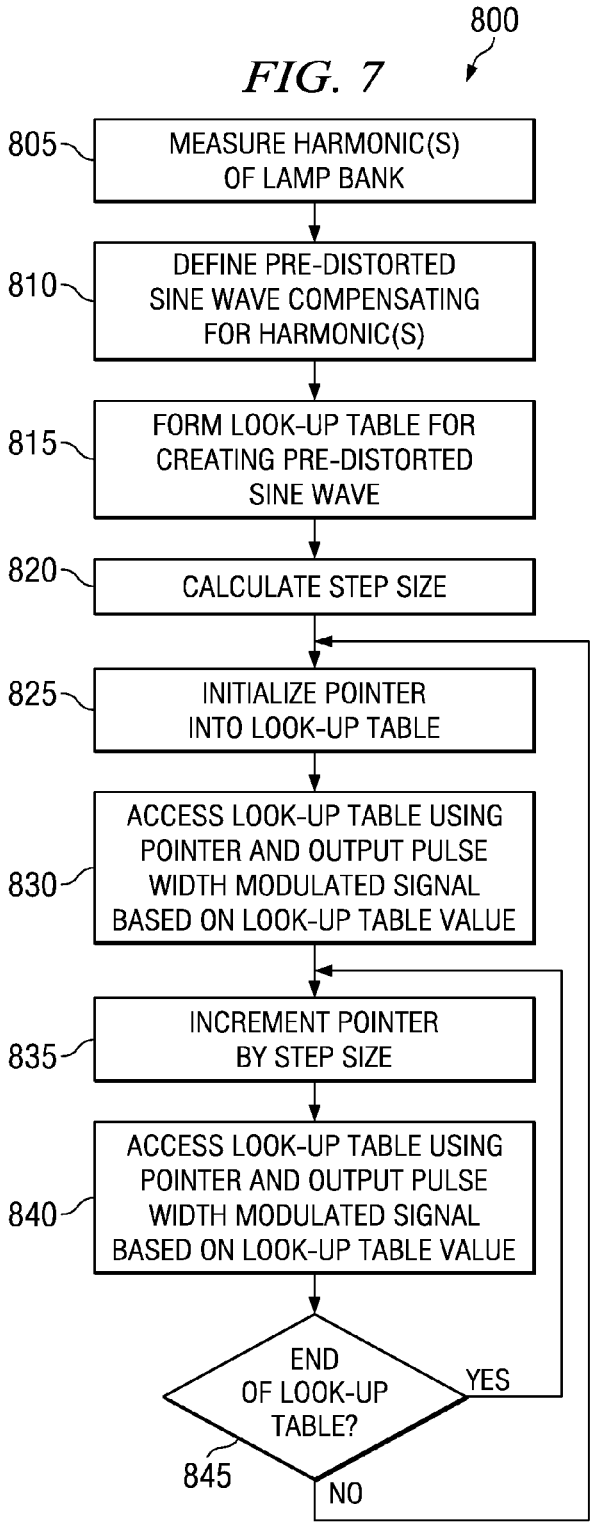
FIG. 7 is a flow diagram showing a method in accordance with some embodiments of the present invention for predistorting a sinusoidal drive signal.

Turning to FIG. 7, a flow diagram 800 shows a method in accordance with some embodiments of the present invention for pre-distorting a sinusoidal drive signal. Following flow diagram 800, a pure sinusoidal voltage is applied to a lamp bank and one or more of the harmonics introduced into the current traversing the lamp bank due to the non-linearities of the lamp bank are measured or otherwise determined (block 805). In some cases, this includes determining the third order harmonic introduced by the non-linearities. In other cases, additional higher order harmonics are also measured or otherwise determined. A pre-distorted sinusoidal voltage is defined to compensate for the previously identified harmonics (block 810), and wave creation look-up table is defined to create the aforementioned pre-distorted sinusoidal voltage wave form (block 815). In addition, a step size for traversing the table is calculated based on a desired frequency as discussed above in relation to FIG. 5 (block 820).

A pointer is initialized to a beginning point within the look-up table (i.e., the start of the pre-distorted output signal), and the value from the look-up table corresponding to the initial pointer is accessed (blocks 825-830). The accessed value is used to create a pulse width modulated signal with a duty cycle corresponding to the accessed value. The pointer is then incremented by the previously calculated step size (block 835), and the value from the look-up table corresponding to the initial pointer is accessed (block 840). The accessed value is used to create a pulse width modulated signal with a duty cycle corresponding to the accessed value. It is then determined if the end of the look-up table (i.e., the end of the pre-distorted output signal) has been achieved (block 845). Where the end ofthe look-up table has been achieved (block 845), the pre-distorted signal has completed and the process begins anew by outputting another period of the same pre-distorted output signal (blocks 825-845). Alternatively, where the end of the look-up table has not yet been achieved (block 845), the period of the pre-distorted output signal has not completed and the processes of pointer incrementing and value output (blocks 835-845) are repeated.

Figure 8A:
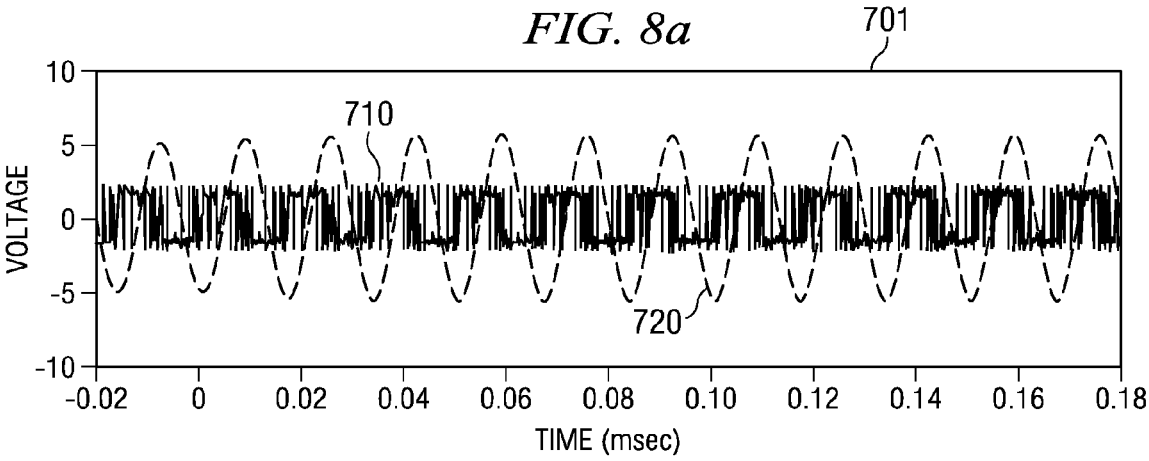
FIGS. 8*a*-8*c* show exemplary pulse width modulated inputs and corresponding sinusoidal voltages for each of the circuits in FIGS. 1, 3 and 5 above.
Figure 8B:
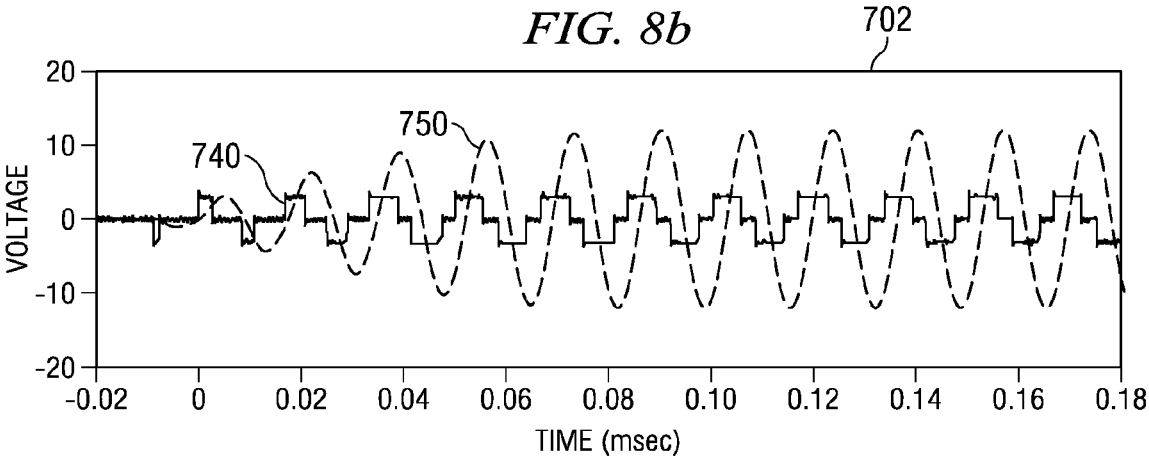
Figure 8C:
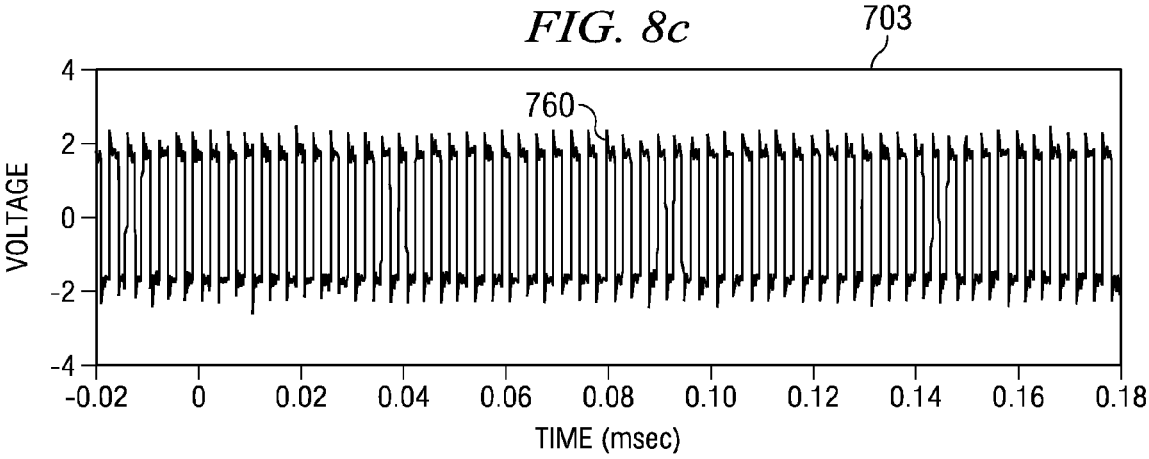

FIGS. 8*a*-8*c* show inputs verses outputs for each of the circuits in FIGS. 1, 3 and 5. In particular, a graph 701 of FIG. 8*a* shows a pulse width modulated output 710 from digital signal processor control element 510 along with the corresponding sinusoidal voltage 720 applied across lamps 560. Of note, sinusoidal voltage 720 may be pre-distorted as discussed above to eliminate the high order harmonics introduced due to the non-linearities of lamps 560. Graph 702 of FIG. 8*b* shows a pulse width modulated output 740 (square wave with a thirty-three percent duty cycle as previously described in relation to FIG. 3*b* above) from digital signal processor control element 310 along with the corresponding sinusoidal voltage 750 applied across lamps 360. Of note, sinusoidal voltage 750 is steadily increasing in magnitude to achieve ignition as more fully described above in relation to FIGS. 1 and 3. Graph 703 of FIG. 8*c* shows a pulse width modulated output 760 from digital signal processor control element 110 that is used to generate the voltage that is applied to lamps 160.

In conclusion, the present invention provides novel systems, devices, methods and arrangements for controlling liquid crystal display lighting. While detailed descriptions of one or more embodiments of the invention have been given above, various alternatives, modifications, and equivalents will be apparent to those skilled in the art without varying from the spirit of the invention. Therefore, the above description should not be taken as limiting the scope of the invention, which is defined by the appended claims.

What is claimed is:

1. An LCD backlight circuit, the LCD backlight circuit comprising:

a lamp;

an analog inverter circuit that provides a drive voltage to the lamp based at least in part on a pulse width modulated (PWM) signal;

a current sensor that is coupled to the lamp so as to sense a current traversing the lamp; and a digital control circuit that is coupled to the current sensor, wherein the digital control circuit compares the sensed current to a threshold current, and wherein the digital control circuit increases the duty cycle of the PMW signal if the sensed current is less than the threshold current so as to increase the drive voltage, wherein the digital control circuit is a digital signal processor, wherein the analog inverter is a class-D inverter, and wherein the control signal is designed to induce a pre-distorted sinusoidal voltage on the drive voltage, wherein the pre-distorted sinusoidal voltage is designed to result in a substantially pure sinusoidal current traversing the lamp.

2. The LCD backlight circuit of claim 1, wherein the digital control circuit is a digital signal processor including a plurality of soft start voltage profiles that are each designed to cause a different magnitude profile on the drive voltage.

3. The LCD backlight circuit of claim 2, wherein each of the plurality of soft start voltage profiles directs a different sequence of duty cycles on the PWM signal.

4. The LCD backlight circuit of claim 1, wherein progressive modification of the PWM signal causes a progressive increase in the drive voltage.

5. The LCD backlight circuit of claim 4, wherein the progressive modification of the PWM signal is a stepped increase in the duty cycle of the PWM signal.

6. The LCD backlight circuit of claim 1, wherein the analog inverter is selected from a group consisting of a Royer oscillator inverter, a push-pull inverter, and a class-D inverter.

7. The LCD backlight circuit of claim 6, wherein the pre-distorted sinusoidal voltage is designed to attenuate a harmonic introduced by the lamp in a current traversing the lamp.

8. The LCD backlight circuit of claim 7, wherein the harmonic is a third harmonic introduced by a non-linearity of the lamp.

9. A method for controlling an LCD backlight, the method comprising:

providing a drive voltage to a lamp from an analog inverter circuit based at least in part on a PWM signal;

sensing a current induced in the lamp by the drive voltage;

comparing the sensed current to a current threshold; and increasing the duty cycle of the PWM signal if the sensed current is less than the current threshold so as to increase the drive voltage, wherein the analog inverter is a class-D inverter, and wherein the control signal is designed to induce a pre-distorted sinusoidal voltage on the drive voltage, forming the pre-distorted sine wave, wherein forming the pre-distorted sine wave includes:

identifying a harmonic introduced by a lamp driven by the class-D inverter; and applying a distortion to a substantially pure sine wave designed to attenuate the identified harmonic.

10. The method of claim 9, wherein the method further comprises:

providing a plurality of soft start voltage profiles, wherein the plurality of soft start voltage profiles are each designed to cause a different magnitude profile on the drive voltage; and selecting one of the plurality of soft start voltage profiles, wherein a duty cycle of the PWM signal is at least in part controlled by the selected soft start voltage profiles.

11. The method of claim 9, wherein the harmonic includes a third harmonic introduced by a non-linearity of the lamp.

12. An LCD backlight control circuit, the LCD backlight control circuit comprising:

a class-D inverter that provides a drive voltage;

a digital signal processor that provides PWM signal to the class-D inverter that induces a pre-distorted sinusoidal voltage on the drive voltage, wherein the pre-distorted sinusoidal voltage results in a substantially pure sinusoidal current traversing the load by attenuating a harmonic introduced by a non-linearity in the load, and wherein the digital signal processor is programmed to:

provide the PWM signal with a first duty cycle, wherein the first duty cycle results in a first magnitude of the drive voltage;

compare the sensed current to a current threshold, wherein the sensed current is less than the current threshold; and based on the comparison, modify the PWM signal to have a second duty cycle, wherein the second duty cycle results in a second magnitude of the drive voltage, wherein the second duty cycle is greater than the first duty cycle, and wherein the second magnitude is greater than the first magnitude.

13. The LCD backlight control circuit of claim 12, wherein the digital signal processor further includes a plurality of soft start voltage profiles, wherein the plurality of soft start voltage profiles are each designed to cause a different magnitude profile on the drive voltage.

* * * * *